United States Patent [19]

Bushnell, Jr.

[11] 4,015,686

[45] Apr. 5, 1977

[54] PORTABLE MULTI-STAGE MECHANICAL LIST

[76] Inventor: Sherman W. Bushnell, Jr., 2924 Western Ave., Seattle, Wash. 98121

[22] Filed: Apr. 4, 1975

[21] Appl. No.: 565,138

Related U.S. Application Data

[63] Continuation-in-part of Ser. No. 327,623, Jan. 29, 1973, Pat. No. 3,876,039.

[52] U.S. Cl. ..... 182/148; 182/112; 187/9 E; 187/11

[51] Int. Cl.[2] ..... E04G 1/22; B66B 9/20

[58] Field of Search ..... 187/2, 9 R, 9 E, 17, 187/27, 11, 8.47, 8.49, 8.5, 73, 80, 81, 82, 83, 95, 84, 85, 86, 87, 88, 13, 14; 182/63, 141, 148, 112, 103, 208, 62.5; 52/121; 248/188.5; 254/4 R, 4 B, 4 C, 143, 144, 175; 214/95 R, 75 R, 670; 308/3.6, 3.8

[56] References Cited

UNITED STATES PATENTS

| | | | |
|---|---|---|---|
| 180,252 | 7/1876 | McClunie | 182/62.5 |
| 2,632,530 | 3/1953 | Wagner | 182/148 X |
| 2,894,605 | 7/1959 | Leavit | 187/11 |
| 3,414,086 | 12/1968 | Ulinski | 187/9 E |
| 3,601,342 | 8/1971 | Piasecki | 52/121 X |
| 3,606,039 | 9/1971 | Weston et al. | 187/81 X |
| 3,734,240 | 5/1973 | Tang | 187/9 E |
| 3,819,013 | 6/1974 | Crum | 187/11 |

*Primary Examiner*—Evon C. Blunk
*Assistant Examiner*—James L. Rowland
*Attorney, Agent, or Firm*—Seed, Berry, Vernon & Baynham

[57] ABSTRACT

A portable multi-stage lift has a winch-operated reeving system operable from ground level or from the lift carriage. The stages of the lift mast slidingly interfit front to back and each has the same cross-section shaped to be formed of a single extrusion. Provision is made for automatically locking the lift stages and carriage together if the cable in the reeving system were to fail.

13 Claims, 12 Drawing Figures

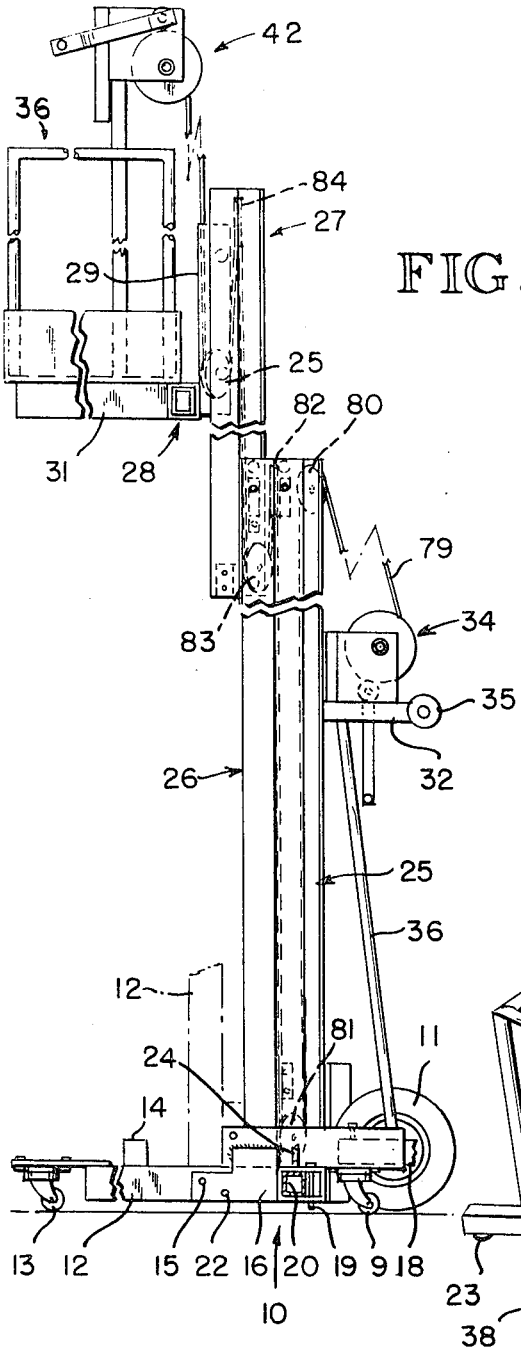
FIG. 2
FIG. 1
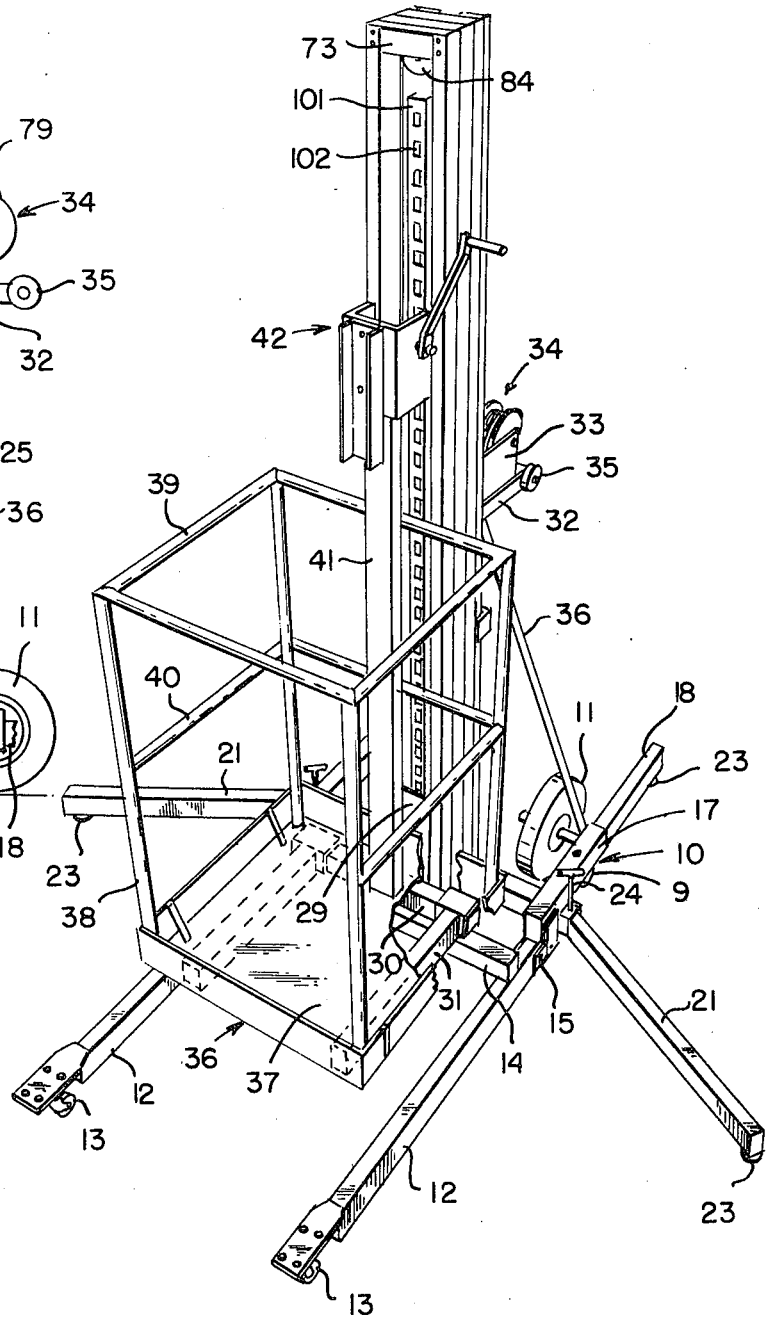

FIG. 4
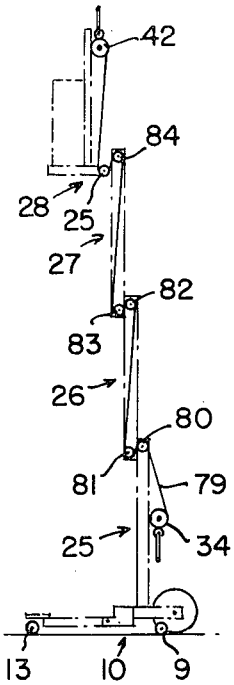
FIG. 7
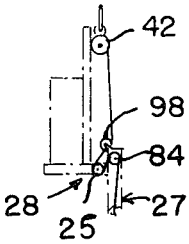
FIG. 6
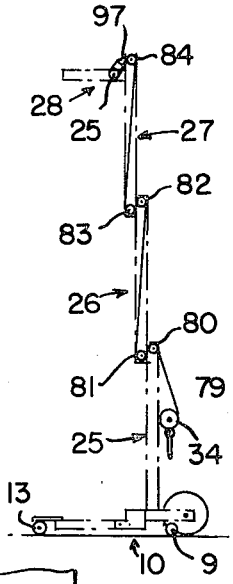
FIG. 3
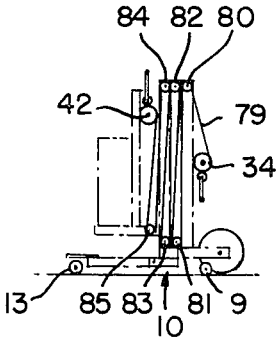
FIG. 5
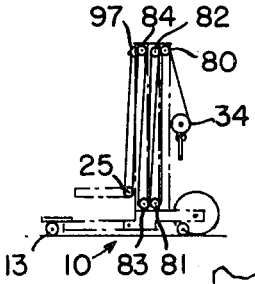
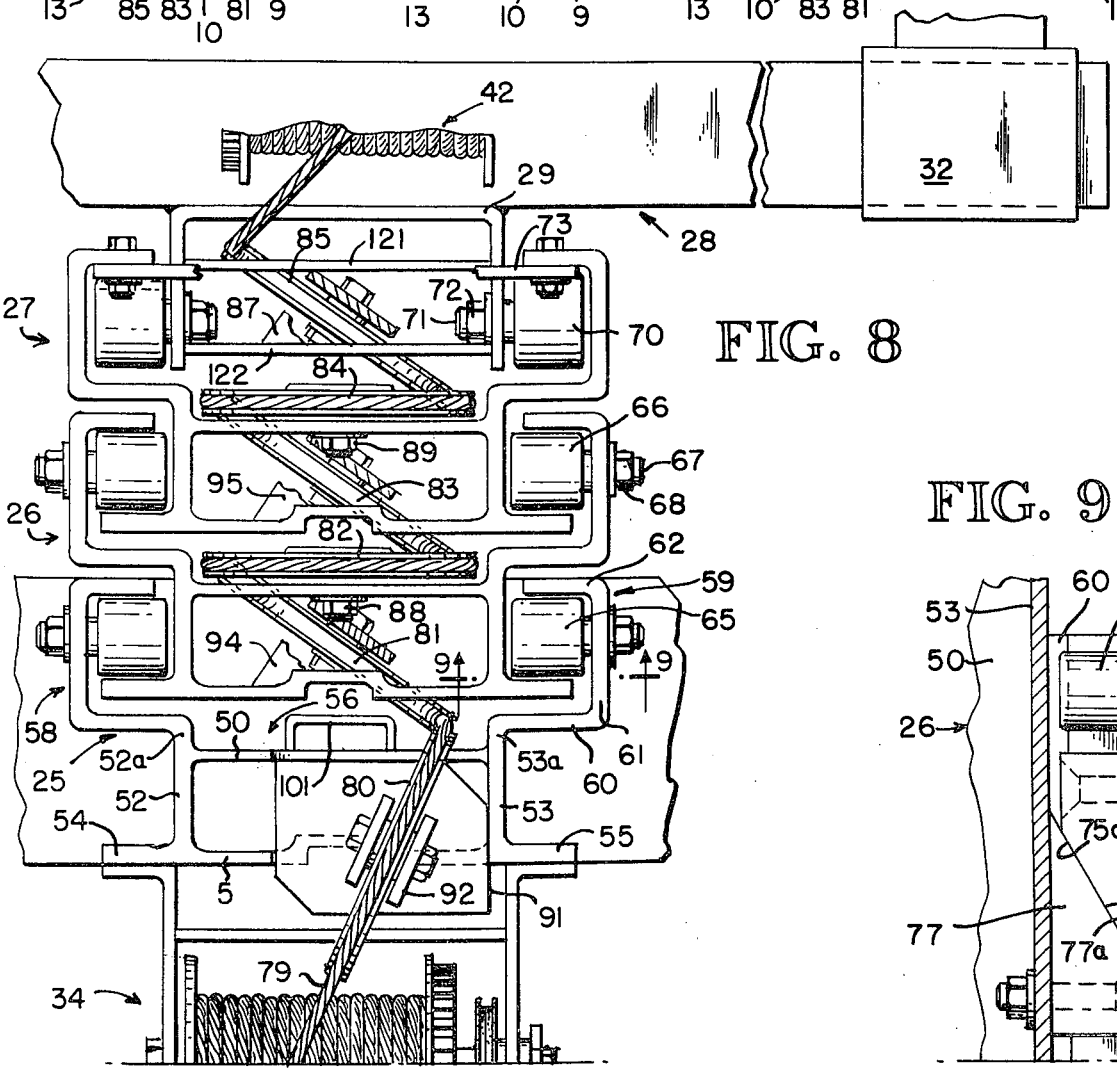
FIG. 8
FIG. 9
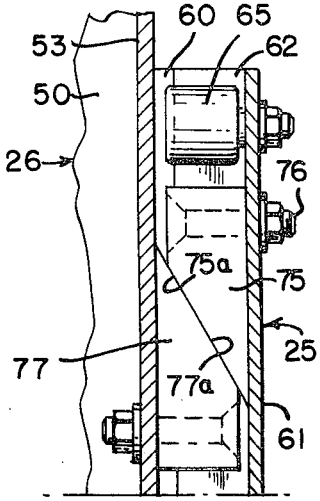

PORTABLE MULTI-STAGE MECHANICAL LIST

BACKGROUND OF THE INVENTION

This application is a continuation-in-part of my copending application Ser. No. 327,623, filed Jan. 29, 1973, which will issue on Apr. 8, 1975, as U.S. Pat. No. 3,876,039, and relates to an improved portable multi-stage lift having a reeving system operated by a winch for extending and retracting the mast assembly.

For construction and repair service work, it is often necessary that relatively heavy materials or equipment be transported at a work site and raised to an elevated position, or that equipment be lowered from an elevated location for repair or replacement, or that a worker be raised to an elevated working position not accessible by way of a ladder. In such instances, the lifting requirement is often about 250 pounds raised to a working height in the neighborhood of 25 feet.

Portable hydraulic and pneumatic lift units have been developed that can accomplish such a requirement, but they have a relatively high cost, have a bulk and weight making them difficult to handle in that they may not be readily transported in a panel or pickup truck nor be easily manually moved from the transporting vehicle to the work site, and frequently have a relatively long setup time. Furthermore, they normally do not have adequate safety provisions, particularly when used as a man lift.

Another performance difficulty often experienced with multi-stage lifts in the prior art is interference by the lift mast with the desired positioning of the load. This difficulty commonly takes the form of an inability to raise the load to the top of the uppermost stage before such stage or all of the stages have been fully extended. In such instances, it becomes impossible to raise equipment so that it rests directly against an overhead structure for mounting unless the height of such structure happens by chance to coincide with the lifting height of the lift after the lifting platform or carriage has reached the top of the upper stage.

SUMMARY OF THE INVENTION

The present invention aims to provide a superior portable multi-stage lift that is of lightweight and relatively inexpensive construction, easy to transport and handle, quick to place in operating condition or dismantle on the job site, and simple and safe to use.

An important object of the invention is to provide a multi-stage lift in which the load carriage always reaches the top of the upper stage before any of the stages are extended.

The invention further aims to provide an improved multi-stage lift which has a reeving system that can be operated by a manually powered winch.

Another object is to provide a multi-stage lift having a reeving system that can be selectively operated by a winch carried by the load raising carriage or by a winch at ground level.

A further object is to provide a safety device for a lift of the type in which the carriage is raised by operation of a reeving system, which will automatically lock the carriage and any extended mast sections against downward movement if the cable in the reeving system breaks.

The invention also aims to provide an improved multi-stage mast in which each stage has the same cross-section and can be formed from a single aluminum extrusion.

Other objects of the invention will become apparent from a reading of the detailed description to follow taken in conjunction with the drawings.

In carrying out the objects of the invention, there is provided a bottom stationary mast, one or more intermediate masts, and a top mast having a carriage. The masts are of identical cross-section and nest together one in front of another. A reeving system causes the intermediate and top masts to extend after the carriage raises along the top mast, responsive to taking in of the cable by a winch. The carriage and the top and intermediate masts have vertically sliding sheave assemblies which are spring-urged downwardly in opposition to upward limited movement caused by the tension in the cable of the reeving system. If the cable breaks, the resulting downward movement of the sheave assemblies causes latches to lock the carriage and masts together. In one of the embodiments, the cable in the reeving system is wound on a winch carried by the carriage, as well as on a winch mounted on the stationary bottom stage, so that a worker can manually operate the extension and retraction of the lift from a platform on the carriage, and a man on the ground can do the same should the worker become disabled.

BRIEF DESCRIPTION OF THE FIGURES OF THE DRAWINGS

FIG. 1 is a front perspective view of a lift embodying the present invention and shown ready for use in retracted position and with its carriage equipped with an optional load-carrying basket and a winch;

FIG. 2 is a fragmentary side elevational view illustrating the top mast in fully extended position;

FIG. 3 is a schematic view corresponding to FIG. 1;

FIG. 4 is a schematic view corresponding to FIG. 2; but with both the top and intermediate masts fully extended;

FIG. 5 is a schematic view corresponding to FIG. 3; but without the basket and related winch, and showing an alternative reeving arrangement as between the carriage and the top mast section;

FIG. 6 is a schematic view showing the alternative reeving arrangement of FIG. 5 when the mast assembly is fully extended;

FIG. 7 is a fragmentary schematic view corresponding to FIG. 4, but with an alternative reeving arrangement to the winch on the carriage;

FIG. 8 is a top plan view of the mast assembly;

FIG. 9 is a detailed transverse sectional view taken as indicated by line 9—9 in FIG. 8;

DETAILED DESCRIPTION OF THE PREFERRED EMBODIMENTS

Figure 10:
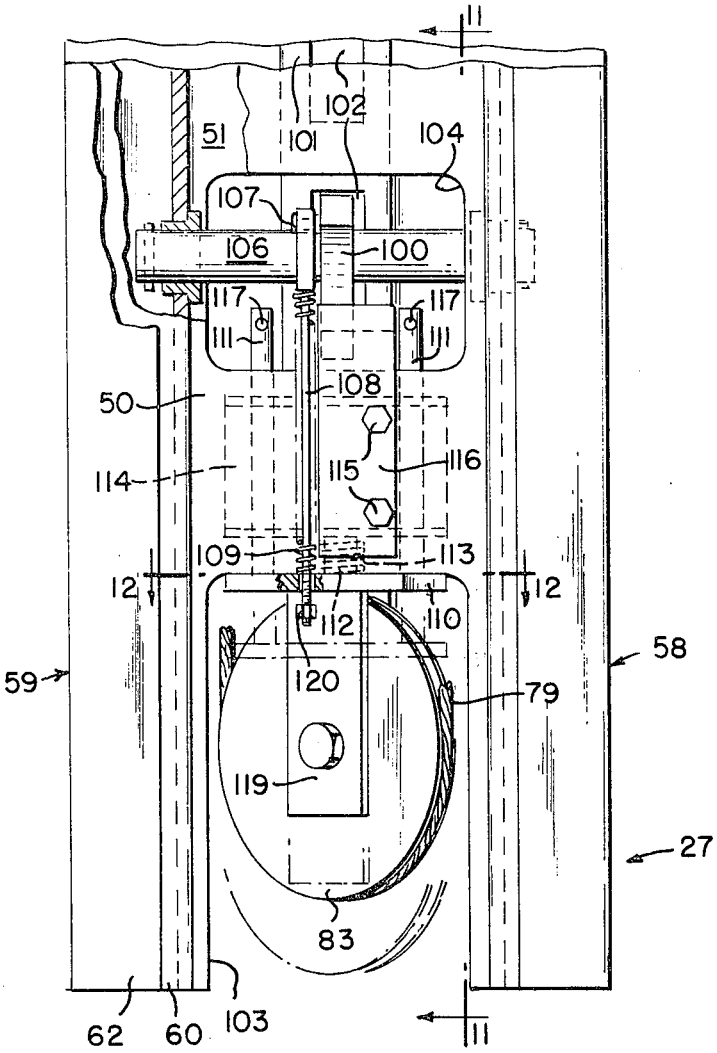
FIG. 10 is a fragmentary front elevational view of the lower end portion of one of the masts.
Figure 11:
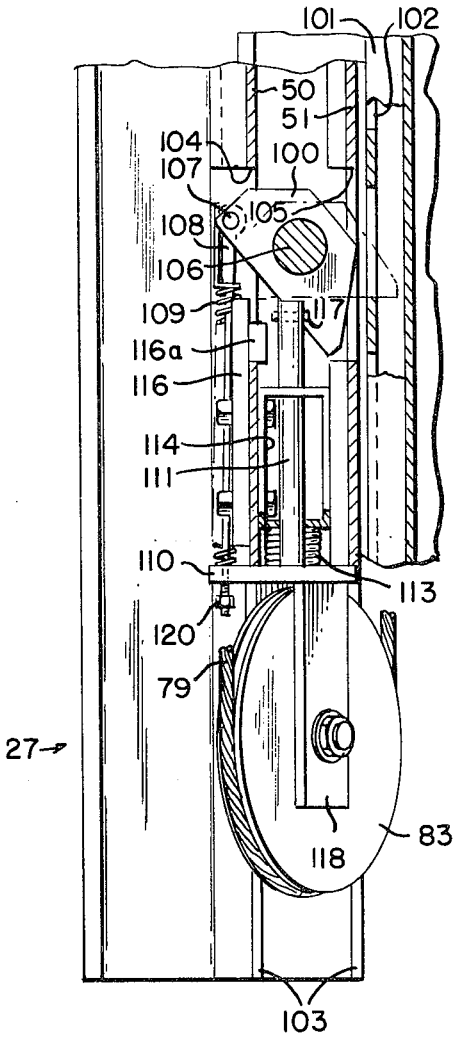
FIG. 11 is a transverse vertical sectional view taken along the line 11—11 of FIG. 10.
Figure 12:
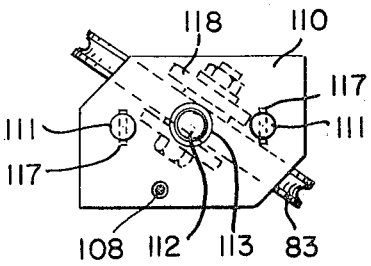
FIG. 12 is a horizontal sectional view taken as indicated by line 12—12 in FIG. 10, but with the entire slide plate unit shown in plan view.

Referring to the drawings, the multi-stage lift of the present invention has a mobile base assembly 10 with a pair of transport wheels 11, a pair of rear casters 9, and a pair of front outriggers 12 equipped with casters 13 at their forward end. The casters 9 and 13 define a ground-engaging plane slightly below the bottom surface of the transport wheels 11 and are normally used on the work site to move the lift. It will be noted that the front outriggers are crossbraced at 14 and pivoted at 15 to side brackets 16 welded to the front of longitudinal base members 17. These base members are tubular to slidingly receive a pair of rear outriggers 18 and they surmount the ends of a tubular cross-member 20 to which they are rigidly fixed. A third pair of outriggers 21 of square cross-section are provided which may have their inner ends fitted into the ends of the cross-member 20 between a pair of vertical pins 19 spaced along the longitudinal center line of the cross-member and locked by removable lock screws 24 in a forwardly diverging position shown in FIG. 1. As seen in FIG. 2, outriggers 18, 21 have leveling screws 23 at their outer ends which are preferably raised sufficiently to lift the wheels 11 out of ground contact.

The cross-member 20 has an internal size to receive the outriggers 21 side-by-side therein, and the outriggers 18 store within outriggers 21. As indicated by the fragmentary phantom position in FIG. 2, the front outriggers 12 may be swung upwardly into a compact stowage position on the pivot pins 15, and are locked down in operative position by removable locking pins 22.

For purposes of example, the lift has been illustrated as having a three-stage mast comprising a stationary bottom mast 25 fixed to the cross-member 20, an intermediate mast 26 slidingly mounted on the bottom mast, and a top mast 27 in turn slidingly mounted on the intermediate mast. As will be apparent from the following description, additional like intermediate masts can be provided if additional stages are desired.

A carriage 28 is slidingly mounted at the front of the top mast 27 and comprises an upright rearwardly facing channel member 29 and a laterally projecting horizontal member 30 of square cross-section which are best shown in FIG. 8. The carriage has a pair of front forks 31 with rear box collars 32 sleeved onto the ends of the lateral member 30. These forks can be conveniently stowed in an upright position by sliding them outwardly free of the member 30 and then placing them back onto the ends of the latter after turning them upwardly ninety degrees. When the forks 31 and pairs of outriggers 12, 18 and 21 are in their afore-described respective stowage positions, the lift unit can be rocked back onto the transport wheels 11 and conveniently wheeled to another work site or transporting vehicle by gripping a U-shaped rear handle unit 32 rigidly projecting from the back of the bottom mast 25. This handle unit straddles the check plates 33 of a winch 34 which are bolted thereto to support the winch.

It will be observed that a laterally spaced pair of small wheels 35 are journal-mounted on the handle unit 32. These wheels 35 complement the transport wheels 11 when it is desired to roll the lift when stowing it in horizontal position as in the bed of a pickup truck. Sloped tubular braces 36 are provided between the rear end portions of the longitudinal members 17 and the bottom mast 25, and these are located in a convenient position to also serve as slide bars when the lift is being pulled, for example, up over the end of the tailgate of a pickup truck for transport.

A personnel basket 36 may be carried on the forks 30, and comprises a platform, corner posts 38, handrails 39 interconnecting the upper ends of the corner posts, intermediate rails 40 at the back and two lateral sides, and a rear stanchion 41 for carrying an optional winch 42. Locking pins may be provided to hold the basket against horizontal movement relative to the carriage.

Continuing to the masts 25–27, such may be identical in cross-section and each comprises a length of extruded aluminum bar stock whose cross-section is shown in FIG. 8. It will be seen that each mast has a rear box section of generally rectangular cross-section having front and back walls 50–51 and a pair of narrower side walls 52–53 extending therebetween. At the rear corners of the box section, the back wall 51 is continued laterally in opposite directions as side flanges 54–55 which, in the case of the intermediate and front masts 26–27, serve as roller tracks, and hence will be designated as track flanges. At the front corners of the box section, the side walls 52–53 are continued as side flanges **52*a*, 53*a* extending forwardly of the front wall 50 a relatively short distance to define therewith a shallow channel to serve as a cableway 56. The mast cross-section is completed at the front by a pair of opposed side channels 58–59 which extend laterally of the planes of the side walls 52–53 in parallel spaced relation to the track flanges 54–55. These side channels each comprise a rear flange 60 continuing from the respective side flange 54–55, a center web 61, and a front flange 62.**

The width of the side channels 58–59 between their rear and front flanges 60, 62 is approximately the same as the distance between the rear flanges 62 and the track flanges 54–55, and the width of the front flanges 62 is approximately that of the track flanges. Both the front flanges 62 and the track flanges 54–55 are narrower than the rear flanges 60. With the described mast configuration, the masts 25–27 can be nested as shown in FIG. 8, with the track flanges 54–55 of one projecting laterally into the channels 58–59 of another and located adjacent the rear flanges 60 to provide space between the front flanges 62 and the track flanges for guide rollers. In the case of the rear and intermediate masts 25–26, there are vertical pairs of guide rollers 65–66, respectively, with the top roller of each pair journal-mounted on an axle bolt 67 extending through the respective channel web 61 and receiving a nut 68, and the bottom roller of each pair (not shown) similarly mounted on side flanges 52–53 to track on flanges 60 through cutouts in track flanges 54–55.

Similarly, the carriage 28 has pairs of vertically spaced rollers 70 riding in the side channels 58–59 of the top mast 27. These rollers 70 are mounted on axle bolts 71 extending through the side flanges of the carriage channel 29 and held by nuts 72. In this regard, it will be noted that these side flanges extend rearwardly between the side channels of the top mast 27 and are spaced apart substantially the distance apart of the side walls 52–53. When the carriage 28 is loaded, the upper of the rollers 70 engage and track on the front flanges 62 of the side channels 58–59 of the top mast 27 while the lower of the rollers 70 ride against the track flanges 54–55 of the top mast. Upward travel of the carriage relative to the top mast is limited by an upper cross-bar 73.

Referring to FIG. 9, in each of its side channels 58–59 adjacent the top thereof, the bottom mast 25 has a respective wedge block 75 bolted at 76 to the channel web 61 and presenting a downwardly and outwardly sloped bottom wedge face **75*a*. This wedge face is opposed by a respective top wedge face 77*a* presented by a wedge block 77 bolted at 78** to the opposing side flange 53 of the intermediate mast 26 near the lower end thereof. Similarly, the top mast 27 has a wedge block 77 near its lower end opposed by a wedge block 75 adjacent the top of the intermediate mast 26. The function of the wedge blocks 75, 77 is to laterally align and lock the masts relative to one another when the top and intermediate masts reach their fully extended positions so that the masts 25–27 will collectively form a stiff column when the carriage 28 is at its maximum height.

Continuing to the reeving system of the present invention for extending and controlling retraction of the masts 26–27, as indicated schematically in FIG. 5, a series of six sheaves 80–85 is provided for a cable 79 connected to the drum of the winch 34. Sheaves 80, 82 and 84 are mounted, respectively, at the upper end of the bottom, intermediate and top masts, and sheaves 81 and 83 are mounted near the lower ends of the intermediate and top masts, respectively. Sheave 85 is similarly mounted near the lower end of the carriage channel 29.

As shown in FIG. 8, the upper sheaves 82 and 84 occupy the top of the cableways 56 of the intermediate and top masts and are journaled by axle bolt assemblies 88–89, respectively, passing through the respective front wall 50. These bolt assemblies can continue through the respective back wall 51 for added support, if desired, in which case the nut is housed in a longitudinal groove formed in the back of the back wall.

The lower sheaves 81, 83 and carriage sheave 85 have their planes on parallel diagonals as viewed from the top so as to form a zigzag pattern with the sheaves 80, 82 and 84 when viewed from the top. In this regard, as shown in FIG. 8, the sheave 80 at the top of the bottom mast 25 is preferably set at such an angle as to align at the rear midway of the axial length of the winch 34. This is accomplished by cutting out top portions of the front and back walls 50, 51 of the bottom mast and providing an appropriate mounting plate 91 having upstanding forks 92 through which the axle bolt for the sheave 80 extends. Similarly, lower end portions of the walls 50–51 of the intermediate and top masts are cut away to receive the lower sheaves 81, 83 which have appropriate mounting assemblies to be later described in detail.

With the indicated sheave arrangement, the cable 79 travels from the winch 34 upwardly over sheave 80 and down the right side of the cableway 56 of the bottom mast (as viewed in FIG. 8) to the right side of diagonal sheave 81. The cable passes from the left side of sheave 81 upwardly in the left side of the cableway 56 of the intermediate mast to sheave 82 and then back down the right side of that cableway to the right side of diagonal sheave 83. From the left side of the latter, the cable travels up the left side of the cableway of the top mast to sheave 84 and back down the right side of this cableway to the right side of the carriage sheave 85. Then, if the basket 36 and winch 42 are being used, the cable travels from sheave 84 to this winch. If not, the cable is returned from the front of the carriage sheave back to the upper end of the top mast and dead-ended at 97 as shown schematically in FIGS. 5–6.

When the basket winch 42 is included, extra cable is provided so that when the carriage is fully raised by operation of the basket winch, as much cable remains on the drum of the ground level winch 34 as is wound on the drum of the basket winch when the carriage is in fully raised position. By this arrangement, it then becomes possible for someone at ground level to lower the carriage by letting out cable from the winch 34 in case the occupant of the basket should become disabled and unable to operate the basket winch 42.

It has been found that when the carriage forks 31 are heavily loaded, the carriage 28 will commonly not rise to the top of the top mast 27 before the top mast is raised responsive to operation of the winch 34 if the cable 79 is dead-ended on the carriage after leaving the sheave 84, or is dead-ended on the carriage winch 42 when reeved as shown in FIG. 1. It also has been found that the foregoing result is not normally experienced when the carriage winch 42 is operated rather than the winch 34. Apparently, the frictional load on the sheaves 83–84 can be such that when the winch 34 is operated, the least resistance to movement is encountered when the top mast moves upwardly before the carriage travels relative to the top mast. On the other hand, when the carriage winch 42 is operated, the sheaves 83–84 do not have to turn in order for the carriage to travel upwardly along the top mast in view of the fact that the cable take-up by the winch 42 first occurs only in the cable path between the winch 42 and the sheave 84.

The reeving arrangement in FIGS. 5–6, wherein the cable 79 is dead-ended at 97 at the top of the mast 27 after passing beneath the carriage sheave 85, gives a mechanical advantage to the carriage relative to the top mast 27 which is not present as respects the top mast relative to the intermediate mast. This mechanical advantage causes the carriage 28 to always move upwardly first when the winch 34 is operated. If desired, the same result can be achieved when the carriage winch 42 is provided, if a second sheave 98 is added at the top of the top mast 27 as shown in FIG. 7 and the cable 79 is reeved around this sleeve 98 in its travel between the carriage sheave 85 and the winch 42.

For safety, provision is made for locking the carriage 28 to the top mast 27 and the masts 25–27 together if the cable 79 should break while the masts are partially or fully extended. This is accomplished in like manner at the lower ends of the intermediate and top masts and on the carriage 28 by way of a slide mounting of the lower sheaves 81, 83 and 85 whereby these sheaves move downwardly relative to the masts if the cable fails, and by such downward movement actuate a respective latch 100 which responsively swings into locking engagement by its rear end with an opposing channel 101 having a row of latch-receiving openings 102 therealong. A respective one of these channels 101 is mounted on the front face of each of the three masts in the manner shown in FIG. 1 as respects the top mast 27.

As seen in FIG. 10 for mast 27, each of the masts 26–27 has a bottom recess 103 and a cutout 104 adjacent thereto in its front wall 50 of rectangular shape. The cut-out 104 is matched by a cutout 105 in the back wall 51 to provide access by the latch 100 to the opposing locking channel 101 on the next mast therebehind. The latch 100 is fixed at the center of a shaft 106 having its ends journaled in bearings passing through the adjoining side walls 52–53. At its forward end, the latch 100 is pivotally connected at 107 to an actuating rod 108 which has its lower end threaded and loosely passing through a hole in a horizontal slide plate 110 near the front edge thereof. A nut 120 on the rod 108 beneath the slide plate 110 causes downward movement of the rod responsive to downward movement of the slide plate, and a compression spring 109 is sleeved on the rod between the head thereof and the slide plate.

The slide plate extends rearwardly through both of the cutouts 104–105 and is slide-mounted for vertical movement by way of a pair of vertical slide rods 111 which project upwardly therefrom through guide holes in a horizontally extending, tubular box section 114 of rectangular cross-section which is bolted at 115 to the front wall 50 below the cutout 104. It will be noted that the bolts 115 also secure a stop block 116 in place for limiting downward swing of the forward end of the latch 100 responsive to downward travel of the rod 108. This stop block has a rear lug 116*a* welded thereto and bearing against the bottom edge of cutout 104 to assist the bolts 115 in taking any downward shock load on the top of the stop block by the latch. The rods 111 extend above the box section 114 and each receives a retainer pin 117. To yieldingly urge the slide plate 110 downwardly, there is provided a compression spring 113 which bears at the top against the underside of the box section 114 and is retained by a central round stub 112 on the top of the slide plate. On its underside, the slide plate 110 has welded thereto a pair of vertical plates 118–119 serving as sheave mounting forks arranged in a generally diagonal direction in plan view.

As previously indicated, the mounting assembly for sheave 81 at the lower end of mast 26 is the same as for that described above for sheave 83. The mounting arrangement for the carriage sheave 85 is also the same. For this purpose, a pair of front and back cross-plates 121–122 are provided extending between the flanges of the channel 29 and spaced apart the same as the mast walls 50–51. These cross-plates have a vertical width corresponding to the vertical width of the portions of the mast walls 50–51 between cutouts 104–105 and the bottom recess 103 and, together with the flanges of the channel 29, support a sheave mounting and latching assembly 100, 106–119 in the same manner.

When the carriage 28 is loaded and the cable 79 is tensioned by one of the winches 34, 42 to raise the carriage and extend the masts 26–27, the slide-mounted sheaves 81, 83 and 85 are pulled upwardly in opposition to the spring 113 by the tensioned cable to their upper limit of travel and the latches 100 responsively have their forward ends rocked upwardly by action of the rods 108 and springs 109, thereby rocking their lower latching ends downwardly free of the locking channels 101 therebehind. Should the cable 79 break, the sheaves 81, 83 and 85 will then immediately drop relative to the masts by gravity and action of the spring 113. This downward movement of the sheaves pulls the respective rods 109 downwardly, thereby causing the latches 100 to swing to locking position into the opposed recesses 102 of a respective locking channel 101. At that time, the front portion of the bottom edge of each latch 100 engages the top of the underlying stop block 116. During the aforesaid downward movement of rods 109, there is sufficient play in the holes through which they pass in the slide plates 110 to allow for the arc swung by the pins 107 which connect the rods to the latches 100.

It will be seen from the foregoing description that I have provided a portable, lightweight and relatively inexpensive lift unit that is convenient to transport, easy to handle and operate, and unusually safe to use. The carriage will always lift first and the mast is rigid when extended. Operation can be by way of the stationary winch at ground level or a winch carried by the carriage. The principles embodied in the lift unit may be applied in different, but equivalent manners from the forms shown and described, and to lifts of varying heights and numbers of stages.

The embodiments of the invention in which a particular property or privilege is claimed are defined as follows:

1. In combination:

a first mast having a stop, a sheave assembly slidably mounted on the first mast for downward movement relative to said stop, a latch carried by the first mast for movement between inactive and latching positions, means for moving the latch from inactive position when said sheave assembly engages said stop into latching position when said sheave assembly moves downwardly away from said stop, and a second mast slidingly carrying said first mast and having a row of vertically spaced recesses arranged to receive said latch when the latch is in latching position whereby the first mast is locked against downward movement relative to said second mast when said latch occupies one of said recesses.

2. The combination according to claim 1 in which a cable passes around the underside of said sheave assembly and urges it upwardly against said stop when the cable is tensioned, and a reeving system including said cable and sheave assembly for moving the first mast relative to the second mast responsive to tensioning of the cable.

3. In combination:

a mast having relatively movable elongated mast sections, top and bottom spaced sheaves mounted on one of the mast sections for limited relative movement toward and away from one another, spring means between said sheaves biasing them away from one another, a cable urging said sheaves toward one another in opposition to said spring means when the cable is tensioned, a latch carried by said one of the mast sections and arranged to move into a latching position responsive to relative movement of the sheaves away from one another and into an inactive position responsive to relative movement of the sheaves toward one another, and a series of latching shoulders arranged along the other of said mast sections for engagement by said latch when it moves into latching position.

4. A lift comprising:

a first mast, a second mast slidably mounted on the first mast to move endwise relative thereto, a carriage mounted on the second mast to move therealong, a reeving system operatively associated with said masts and carriage for moving the carriage relative to the second mast and for moving the second mast relative to the first mast, said reeving system including a cable, a first sheave assembly on the carriage having restricted movement relative to the carriage in opposite directions endwise thereof responsive to slackening and tensioning of the cable, a second sheave assembly near the top of said second mast, and a third sheave assembly near the bottom of said second mast having restricted movement relative to the second mast in opposite directions endwise thereof responsive to slackening and tensioning of the cable, locking means operatively associated with the reeving system, carriage and masts for locking the carriage against downward movement relative to the second mast and for locking the second mast against downward movement relative to the first mast responsive to movement of said first and third sheave assemblies caused by slackening of said cable due to failure of the reeving system, and spring means operatively associated with said first and third sheave assemblies for yieldingly urging them to move in the direction causing said locking means to lock the carriage and second mast.

5. A lift according to claim 4 in which said locking means comprises respective latches carried by the carriage and said first mast and movable between an inactive position when said cable is tensioned and a latching position when the cable is slackened, and rows of recesses along said first and second masts arranged to receive said latches when they are in latching position.

6. A lift according to claim 5 in which second spring means yieldingly urges said latches into said inactive position and is overcome responsive to movement of said first and second sheave assemblies caused by the first-mentioned spring means when the cable is slackened.

7. A lift according to claim 5 in which said latches are pivotally connected to respective pull rods and are arranged to swing into and out of latching position responsive to pull action and push action, respectively, on the pull rods, operative connection between said pull rods and said first and third sheave assemblies for exerting a pull on the rods when the cable is slackened, and second spring means yieldingly exerting a push on the pull rods to move the latches into inactive position when the cable is tensioned.

8. A lift according to claim 4 in which said cable is dead-ended on said second mast, passes beneath said first sheave assembly, over said second sheave assembly, and beneath said third sheave assembly, and winch means free of said carriage and second mast and having said cable wound thereon.

9. A lift according to claim 8 in which said carriage has a removable operator-carrying basket means, a second winch means mounted on said basket means, and means for selectively disconnecting the dead-ended end of the cable from said second mast and connecting it to said second winch means so that the lift can be operated from the basket.

10. A lift according to claim 4 in which said masts interfit, and wedge means mounted at opposite ends of said masts and arranged to engage one another and stiffen the masts as a unit when the masts have moved endwise relative to one another to a fully extended position.

11. A lift according to claim 4 in which the spring means operatively associated with said third sheave assembly comprises compression spring means located between said second and third sheave assemblies and arranged to bias said third sheave assembly away from said second sheave assembly.

12. A lift comprising:

a mast, a carriage mounted on the mast to move up and down therealong, a reeving system operatively associated with said mast and carriage for raising and lowering the carriage, said system including a first sheave assembly on the carriage having restricted vertical movement relative to the carriage, a second sheave assembly near the top of the mast, and a cable passing beneath said first sheave and over said second sheave assembly, winch means connected to one end of said cable and means for holding the other end of said cable, said first sheave assembly moving upwardly relative to the carriage to the upper limit of its said restricted vertical movement when said cable is tensioned, spring means on the carriage for biasing said first sheave assembly downwardly relative to the carriage, latch means on the carriage movable between an inactive position when the cable is tensioned and a latching position when the cable is slackened such that the spring means moves the first sheave assembly downwardly relative to the carriage, and a column of downwardly facing recesses along said mast to receive said latch when it is in latching position.

13. A mast according to claim 12 in which said carriage has a pair of horizontally projecting forks, a removable operator-carrying basket means carried on said forks, second winch means mounted on said basket means, the other winch means being free of said carriage and basket means, and means for selectively manually connecting said cable to said second winch means or to said mast near the top thereof.

* * * * *